United States Patent [19]

Graat et al.

[11] Patent Number: 4,470,798

[45] Date of Patent: Sep. 11, 1984

[54] METHOD OF OPERATING A BURNER WITHOUT USING A FUEL PUMP, AND BURNER ASSEMBLY OPERATING IN ACCORDANCE WITH SUCH METHOD

[76] Inventors: Johannes W. Graat; Hans T. Remie; A. M. Verhagen, all of c/o Smith Ovens Nijmegen, Groenestraat 265, Nijmegen, Netherlands

[21] Appl. No.: 358,453

[22] Filed: Mar. 15, 1982

Related U.S. Application Data

[63] Continuation of Ser. No. 052,678, Jun. 27, 1979, abandoned.

[30] Foreign Application Priority Data

| | | | |
|---|---|---|---|
| Jun. 28, 1978 | [DE] | Fed. Rep. of Germany | 2812101 |
| Mar. 27, 1979 | [DE] | Fed. Rep. of Germany | 2912102 |
| Mar. 27, 1979 | [DE] | Fed. Rep. of Germany | 2912083 |

[51] Int. Cl.[3] ..... F23M 3/00; F23M 9/00

[52] U.S. Cl. ..... 431/9; 431/12; 431/182; 431/352

[58] Field of Search ..... 431/9, 12, 173, 177, 431/182, 185, 188, 264, 352, 284; 239/406, 403

[56] References Cited

U.S. PATENT DOCUMENTS

| | | | |
|---|---|---|---|
| 836,219 | 11/1906 | Shutz | 431/9 |
| 2,096,945 | 10/1937 | Van Law | 431/185 |
| 2,800,093 | 7/1957 | Burg | 431/173 |
| 2,973,727 | 3/1961 | Northcote | 431/173 |
| 3,221,796 | 12/1965 | Nesbitt | 431/185 X |
| 3,951,584 | 4/1976 | Thekdi | 431/182 X |

*Primary Examiner*—Samuel Scott
*Assistant Examiner*—Randall L. Green
*Attorney, Agent, or Firm*—Fitch, Even, Tabin & Flannery

[57] ABSTRACT

This relates to a method of operating a burner under conditions of stoichiometric combustion, wherein liquid fuel and combustion air are combined in a essentially constant ratio within a mixing and atomizing chamber, whereby a negative pressure is produced within said chamber owing to the guiding and metering of the air, said negative pressure serving to draw in fuel into said chamber. Furthermore, the invention relates to a burner assembly for carrying out the method.

6 Claims, 8 Drawing Figures

METHOD OF OPERATING A BURNER WITHOUT USING A FUEL PUMP, AND BURNER ASSEMBLY OPERATING IN ACCORDANCE WITH SUCH METHOD

This is a continuation of application Ser. No. 52,678 filed June 27, 1979, now abandoned.

The present invention relates to a method of operating a burner under conditions of stoichiometric combustion, wherein liquid fuel and combustion air are combined in a essentially constant ratio within a mixing and atomizing chamber, whereby a negative pressure is produced within said chamber owing to the guiding and metering of the air, said negative pressure serving to draw in fuel into said chamber. Furthermore, the invention relates to a burner assembly for carrying out the method.

A burner construction is known (Niepenberg, "Industrie-Ölfeuerungen", published by Verlag Gustav Kopf & Co., Stuttgart, 2nd edition 1973) which operates with double-stage air supply to the (fuel) oil. By using an injector construction, the oil is introduced into the central air flow in a position where a negative pressure exists, such that the oil is sucked in by the air. By way of the air volume supplied per unit of time, the intake oil volume may be varied at the same time. According to this literature, the ratio between oil and air may be kept constant within a specific burner control range. In the conventional burner, a negative pressure is produced by the air stream in accordance with the Venturi system, with the fuel sucked in being introduced into the region of such negative pressure. As far as can be seen from the literature, the fuel must be supplied through and injector construction. Due to the high air flow velocity in the vicinity of the nozzle mouth, the combustion path is relatively long, whereas the flame should be short in many instances.

Accordingly, it is the object of the present invention to improve a burner of the above-outlined type to the effect that, according to construction, an atomizing nozzle for the fuel is not required, while a substantially stoichiometric combustion nevertheless secured. Combustion should take place over a relatively small length. Atomization and gasification must therefore take place with substantial disintegration of the fuel particles within a restrictable volume, such that a blue flame is obtained, if possible. The energy required to this end should be as low as possible. Besides, operation of the burner should lend itself to be controlled.

These objects are solved by employing a method of operating a burner, wherein the air is guided in such a way as to form a cyclon interiorly of the mixing and atomizing chamber, and wherein the fuel is introduced in the vicinity of the axis of the cyclon.

In this connection, the term "cyclon" refers to a circular motion of the air, whereby slight compression of air towards the periphery of the mixing chamber takes place under centrifugal forces. Owing to this type of air guidance, surprisingly there results a vacuum or negative pressure interiorly of the cyclon, which negative pressure may be utilized to suck in the fuel. Thus, the burner does not require a fuel pump. To this end, it is only necessary that the fuel is introduced in the region of the axis of the cyclon since, as experience has shown, the negative pressure is maximum in this region.

The supplied fuel which may be fed preferably in a compact stream or jet, but alternatively also in a slightly atomized state, is instantly disintegrated by turbulence occuring in the air flow, and divided into minute particles and burnt without soot formation under corresponding temperature conditions. Hereby, it is advantageous when the fuel is supplied as a compact stream or jet having a diameter of from 0.5 to 2.0 mm. In such case, the negative pressure to be produced in the mixing and atomizing chamber should amount to from −0.03 to −0.15 bar (atmospheres) in the vicinity of the nozzle inlet.

Furthermore, it has been shown to be advantageous if the velocity component, normal to the fuel jet axis, of the relative velocity of the air stream upon entrance into the mixing chamber is between about 40 and 250 m/sec. However, this flow rate is not measured directly, but determined on the basis of measurements of values Q, A by using the following equation:

$$v=Q/A,$$

wherein v = velocity,

Q = volume of air per unit of time,

A = cross-sectional area.

By "stoichiometric combustion" in the meaning of the invention, there is meant such combustion in which neither soot (soot number 0, according to Bacharach), nor any noticeable oxygen content in the combustion gases (oxygen content in the order of from 0.01 to 0.1%) appear. Depending to the requirements, the combustion method may be performed even under, below stoichiometric or above stoichiometric conditions without causing soot to be formed.

The term "liquid fuels" relates particularly to fuel oils. These may be fuel oils of classes EL, L or S. The corresponding viscosity values are defined by German Industrial Standards (DIN). The viscosity of oils is greatly reduced with heating, such that, under certain circumstances, a heavy fuel oil may become, when heated, a fuel oil having the viscosity characteristics of a medium fuel oil. However, other substances, such as alcohols, low boiling aliphatic or aromatic substances, are also suitable for combustion.

Preferably, when carrying out the method, all of the combustion air is also used as an atomizing medium in order to make optimum use of the energy content. This also allows to maintain a relatively low air pressure only for the inflowing combustion air. Another significant advantage can be seen in the fact that the combustion particles are absolutely homogeneously intermixed with the air, whereby an extremely short burn-out or combustion period is obtained. Still further, the method according to the invention permits to provide stoichiometric combustion over wide ranges of loads. Hereby, control of performance or efficiency may be effected in easy manner by varying the volume of combustion air supplied per unit of time, by means of controlling the driving power of the associated fan or blower. In this way, the method may be readily controlled.

The burner assembly for carrying out the method includes an inlet opening which is followed by a mixing and atomizing chamber endlosed by a shell (jacket) and into which the fuel jet is introduced. Still further, it includes at least one opening or port through which the combustion air may be fed into the mixing and atomizing chamber. These features can be found also in the prior construction mentioned above.

The burner assembly according to the invention distinguishes itself from the prior art in that the port or ports for supplying the combustion air are formed in the shell of the mixing and atomizing chamber so as to allow to pass the air in a way that a cyclon is formed interiorly of the mixing and atomizing chamber, and in that the inlet port for the fuel is disposed centrally in the front face of the chamber.

Normally, the passage of air for the formation of a cyclon is facilitated in that the feed ports are cut with inclination, such that the feed air flows tangentially with respect to an imaginary circle within the mixing chamber to thereby impart rotation to the content of the mixing chamber. However, it is also possible to employ correspondingly formed air guide plates or air baffle elements which bring about the same effect. The inlet port for the fuel is "centrally" arranged; this expression also implies that it may be deviated from the exact central disposition, or that a plurality of ports may be provided. What is essential is that the fuel is supplied in the region of maximum negative pressure in order that a meximum flow rate may be maintained.

Preferably, the shell of the mixing and atomizing chamber has a cylindrical inner wall in which are provided, as distributed or spaces across the circumference and length, separate apertures or slots as ports; in this construction, from 3 to 20 and preferable 12 apertures are spaced around the circumference of the shell in axially symmetrical disposition.

The mixing and atomizing chamber opens either directly into the heating space of a boiler, or into a space enclosed by a burner shell (jacket). In either case, it has been found advantagous when the free width of the mixing and atomizing chamber from the fuel nozzles or nozzle up to the transition to the combustion chamber is of constant cross-section. Since the fuel is not atomized, but rather preferably supplied in the form of a compact jet, the fuel is not under an excessive pressure. The fuel supply may be easily turned on and off by an electrically operable needle valve closing and opening the inlet port.

The above described burner assembly is primarily suitable for use in connection with household burners having low fuel oil consumption. For example, one-family houses require so-called miniature burners having an oil consumption of the order of from 1 to 3 kg oil of per hour.

However, it is found that the mixture of atomized oil and combustion air is relatively difficult to ignite in the region of the soichiometric ratio. It is only when the mixture has been enriched with an increased portion of oil, that ignition of the mixture becomes possible by means of a spark plug which produces a spark between a pair of electrodes. The difficulty of igniting so-called "blue flame burners" which use in operation a stoichiometric ratio of fuel to air, is solved in the conventional burners by the measure that initially the air supply is reduced by a valve control means with the aid of a servomotor, such that a "richer" fuel-air mixture may flow along the ignition device (laid-open German patent application No. 2,700,671). However, this measure makes the burner system more expensive, operation is complicated, and especially re-ignition following a failed ignition attempt becomes more difficult when a burner is provided with a system for controlling the starting air of this type. Another drawback is the fact that failed starting attempt, unless such failure is due to lack of fuel, also releases a great quantity of soot and cracked products which might severely contaminate the combustion chamber.

Accordingly, it is another object of the present invention to reliably initiate ignition, whith the fuel-air mixture existing with a substantially stoichiometric ratio from the outset, without requiring complex of complicated auxiliary devices. Failed starting attempts when oil supply is present, should be substantially avoided because this involves a high risk of contamination.

This object is solved in that a glow element adapted to be heated is positioned within the mixing and atomizing chamber (MAC) in the stream of the unburnt fuel-air mixture.

Surprisingly, it has been found that conventional electrode-type spark plugs, even such with lyra-type electrodes, are not suitable to ignite, or in extremely unreliable manner only, a lean mixture, this being due apparently to excessively short ignition periods, insufficient energy transmission, or insufficient local ignition area.

On the other hand, when a glow element is used which is formed preferably as a wire helix or ignition spiral, the mixture may flow across such element, whereby the combustion reaction starts immediately when the fuel is admixed to the air. Misfiring cannot be observed at all in practice. Apparently, glow elements or bodies are particularly suitable as igniters because such elements are effective to locally transmit a high amount of heat to the fuel-air mixture in a relatively small survace area, such that combustion is reliably initiated.

The start-up process of the burner takes place in a plurality of steps:

(a) Air supply is turned on, and the combustion chamber is primed. Then, the glow element is heated, with the air supply being kept on. Fuel supply is still stopped.

(b) Upon expiration of a heating period which takes into account the cooling rate of the glow element by the air, a fuel valve is opened, and the fuel is admixed to the air in the finally desired ratio. Ignition takes place immediately when the surface temperature of the glow element at that time is sufficiently above the ignition temperature, i.e. when it has reached the temperature of about 800° C. Initiation of the ignition process is a highly complex process. Apparently, a local energy transfer to the fuel-air mixture must take place for some period of time, in order that the combustion reaction may start. Oil droplets dropping onto the surface of the glow element, evaporate on the glow element and result in a particularly highly inflammable mixture in the area of the hot surface.

(c) As soon as ignition has started, the combustion state is displaed through an ignition monitor, e.g. an ionization sensor, and the ignition power is turned off. The glow element then cools.

In the burner construction according to the application, the mixing and atomizing chamber is designed such that it is of constanct cross-section from one end to the other. The one front face is defined by the front wall which carries the inlet port or ports for the fuel jet. It has shown to be advantageous to mount the ignition spiral or the glow filament in the form of a segment of an arc having an aperture angle of between 30 and 330°, with a close distance from the opening part of the mixing and atomizing chamber. In such construction, the opening part of the mixing and atomizing chamber is partially framed by the glow element. Further, it has been found to be advantageous to mount the glow element or ignition helix with a spacing of from 5 to 30 mm from the front face of the combustion chamber.

In general, the glow element is mounted in such a way that the mixture jet exiting from the mixing and atomizing chamber flows as intensely as possible through this glow element, without said glow element extending fully through the core or on the axis of such jet. It is advantageous to arrange the glow element adjacent the open edge of the mixing and atomizing chmaber as it is known that breaking-off vortices are formed at the edge. If the edge is rounded in order to project the path of the flow away from the axial direction by the Coanda effect, the mounting position of the glow element also can easily be adapted to this flow formation. With such rounding of the edge, a flame cone is formed which has an opening or aperture angle of between 30° and 120°. It is proposed that the glow element in such case in intimate contact with the front face or pressed into a groove.

Normally, the glow element or the ignition helix is disposed in the relatively cool area between the mixing and atomizing chamber and the flame front of the operating burner assembly. In this way it is secured that the mixture flowing, prior to starting the combustion, out from the mixing and atomizing chamber comes into good contact with the glow element disposed in the opening. Upon initiating the igniting process and turning off the heating current, the glow element is then positioned substantially outside of the flame front so that it may have a long service life.

Preferably, the ignition glow element is made of ceramic or of a low oxidizing (low scale) alloy, so that this element is not or almost not subject to oxidization. The configuration of the glow element may differ greatly. This element should be adapted to be heated quickly, and it should have a favorable heat-transfer surface. Conical ceramic glow elements with internal heating soil, strips or spirals (helices) adapted to be heated electrically, or even platlets may be used. Surprisingly, a relative small surface area is sufficient, provided that this surface can be continuously kept at a temperature of about 800° C. during the igniting process. Of course, heating may be effected by induction, high-frequency or similar systems.

In operation of the burner assembly described above, the energy required for the disintegration of the oil droplets is no longer furnished by a separate oil pump, but solely by the flow energy of the combustion air entering the mixing and atomizing chamber. With the customary dimensions of oil and air inlet parts, the air pressures required range e.g. from 0.04 to 0.1 bar. This air pressures require relatively large-size fans or blowers to maintain the required air pressure.

Accordingly, for further improvement of the apparatus it is another object of the invention to reduce the volume of pressurized air required so as to allow fans or blowers or smaller dimensions to be used.

Surprisingly, this object can be solved in that flow-directing elements are installed into the shell tube, which elements cause recirculation of the burning mixture flow divereing from the axis.

Installations of this type which effect forced recirculation of part of the burning mixture, are known per se. It is surprising that a great part of the energy spent in the fans or the like is apparently not at all necessary to maintain circulation and disintegration of the oil droplets, but rather serves to couneract the pressure head or stagnation building up within the shell tube. Thereby, a substantial portion of the energy is wasted. Namely, it has been found that when installations are provided according to the invention, such as, for example, a cylindrical baffle sleeve or collar concentrically positioned in the shell tube and which has peripherally distributed (spaced) suction ports in its side adjacent the mixing and atomizing chamber, the air pressure to be applied may be substantially reduced. A typical example is as follows: No installations—600 mm; with installations—250 mm column of water. In this way, the fan pressure may be greatly reduced whereby in addition to reduction of energy consumption, annoyance by noise is also reduced. In the present case, such great a reduction of the expenditure by relatively simple installation elements cannot be expected to be obtained. Rather, from a plausible consideration it can only be expected that the primary energy of the air flow is utilized for the formation of the cyclon and to overcome the air friction or drag within the conduits and ports leading to the mixing and atomizing chamber.

Another effect that is obtained resides in the fact that larger oil droplets which, under centrifugal force exist predominantly in the region of the swirling flow motion, are recirculated once more so as to move over a longer distance and to become vaporized more completely.

In order to adapt the baffle sleeve to various burner conditions, thermal demand numbers and the like, this sleeve is arranged to be adjustable relative to the front face of the combustion chamber, whereby such adjustment also serves to vary the free cross-section of the suction ports. Structurally, this may readily be attained by mounting the directing or baffle sleeve so as to be movable on a plurality of supports.

Furthermore, the circulation effect may be increases when the shell or jacket tube of the burner extends beyond the baffle sleeve and include a constriction in the projecting portion.

In operation of the above described burner, the phenomenon occurs that a relatively high amount of thermal energy is transmitted through the shell or jacket tube to the surroundings of the mixing and atomizing chamber. Apparently owing to such heating, the fuel flow through the inlet ports may decrease after some period of operation such that the efficiency of the burner assembly is decreased, too. Likewise, the oxygen content may be increased thereby from an initial value of 1% to e.g. 0.5%.

Accordingly, it is a still further object of the invention to prevent this phenomenon from occuring and to ensure a uniform fuel flow even in prolonged operation of the burner assembly.

This object is solved by providing perforations in the shell tube of the burner assembly, which perforations serve to reduce the heat flow from the free end of the shell tube to the end wall of the burner.

Details of the configuration of these perforations which are preferably formed as slots, appear in the subclaims and will be explained in the description of the Figures.

Below, the invention is explained in greater detail in exemplary embodiments by referring to the enclosed drawings, wherein.

Figure 1:
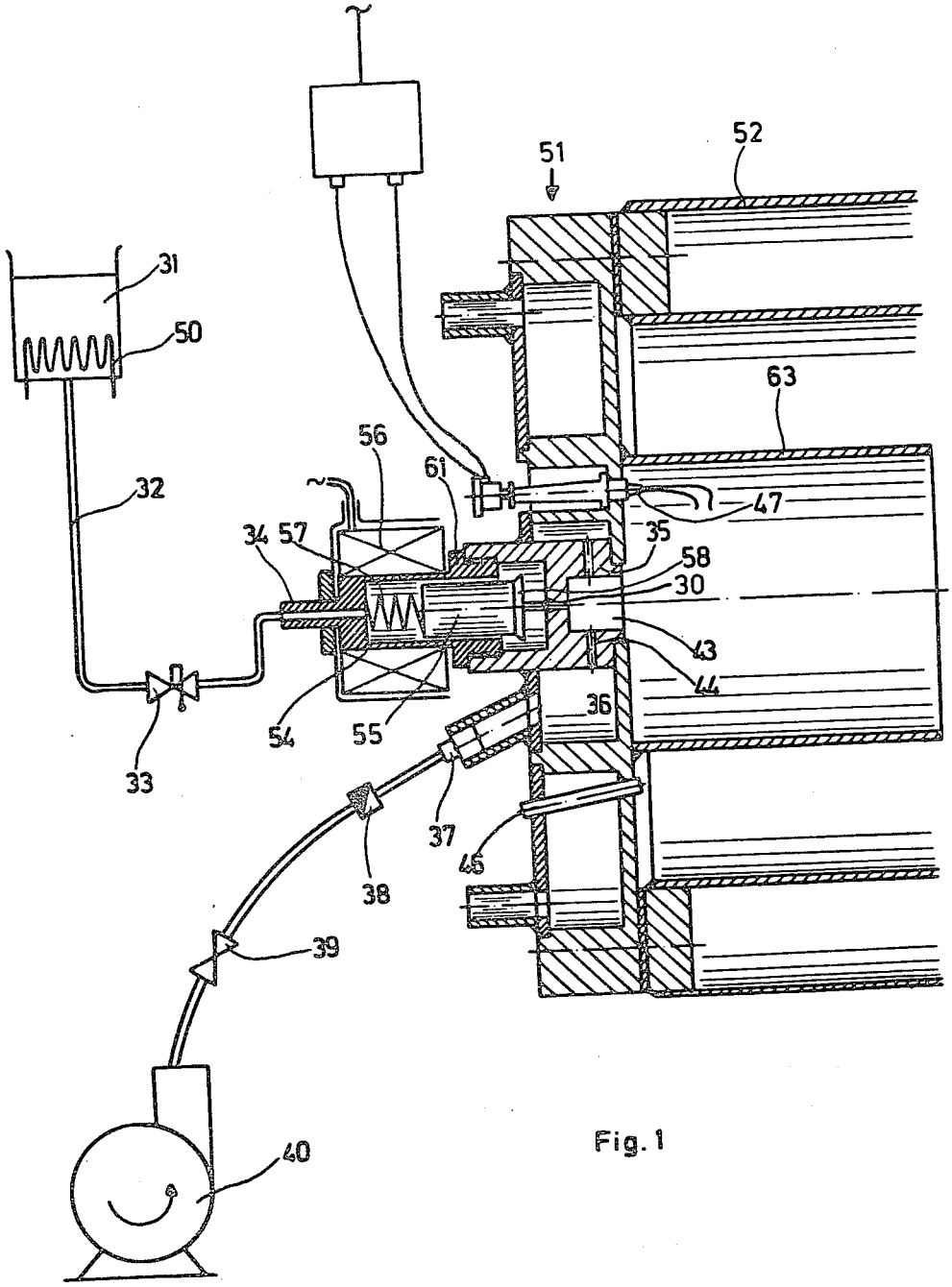
FIG. 1 shows a burner assembly according to the invention.

FIG. 1 shows a specific embodiment of a burner assembly. The fuel, usually fuel oil EL having a viscosity of about 5 cst at 20° C., is fed from a reservoir 31 through a conduit 32 to the burner proper. Installed between the reservoir and the burner is a float control 33 operative to provide for constant pressure between the burner fuel inlet and the level of the float control 33. In this way, the arrangement provides for proportionality between the negative pressure and the volume of fuel per unit of time. Conduit 32 terminates in a bore 34 which, in turn, terminates in an armature housing 54. The latter has movably mounted therein a soft-iron armature 55 which may be drawn into the armature housing 54 by a coil 56 in oppositon to the force of a spring 57. The armature 55 is provided with a collar 58 limiting the travel of the armature into the housing 54. On the side opposite from the coil 56, the armature ends in a valve needle 60 serving to open and close another bore 30. The armature-coil assembly is housed in a housing case 61 being screwed to a cylindrical housing 35 having a pair of differently sized cylindrical bores or apertures extending from the two base sides of the cylinder and communicating via the bore 30. The soft-iron core 55 is movable in one of these bores interiorly of the armature housing 54, while the other bore forms the mixing and atomizing chamber 43 (MAC). The housing 35 is embedded into a front or end wall 51 forming part of the burner housing.

In order to obtain an optimum even flow of the fuel by rendering uniform the viscosity thereof, a tank heater 50 is installed into reservoir 31. This heater may be energized either trough a separate circuit or through heat exchange with the heat exchanger of the central heating boiler. Of course, this auxiliary heating system may be omitted if correspondingly other operational conditions exist.

Air is introduced through an air line via an annular air channel 36 installed into the front wall 51 and being provided with a joining socket 37. Further, the channel includes a weight-loaded valve 38 which prevents air from flowing through the air line into the combustion chamber to cool the latter, when the burner assembly is turned off. Also, the feed air line includes a control valve 39 through which the air taken in by an air compressor 40 is urged into the air channel 36 at a pressure of from about 0.03 to 0.3 bar.

The air channel 36 terminates in air channels or passages 44 provided for supplying the combustion air to the mixing and atomizing chamber 43, in the shell of this chamber. These passages provide for an air supply by which a swirling air motion (cyclon) is produced within chamber 43. The inlet port for the fuel, i.e. bore 30, is centrally positioned in the front face of this chamber relative to the cyclon formed in this chamber.

The jacket or shell of chamber 43 includes a cylindrical inner wall, with a total of 12 axially symmetrically distributed or spaced air channels (bores) 44 being provided. The ends of the air channels opening into the chamber are disposed with a spacing a=5 mm from the outlet end of bore 30, as measured from a projection of bores 44 to the axis of chamber 43.

It is essential that the air channels 44 are positioned such that the air upon entering the mixing chamber is directed to diverge under an angle of from 10° to 60° from the normal direction. Thus, the air is blown tangentially to the periphery of an imaginary circle interiorly of the mixing chamber 43, as can be seen from FIG. 3. It is also possible to dispose the blowing direction of the air channels 44 with inclination relative to the axis of chamber 43, such that the axis of the stream or jet is directed slightly towards the nozzle mouth or away therefrom. Preferably, the mixing chamber 43 is designed with constant cross-section from the nozzle to the mouth.

Figure 3:
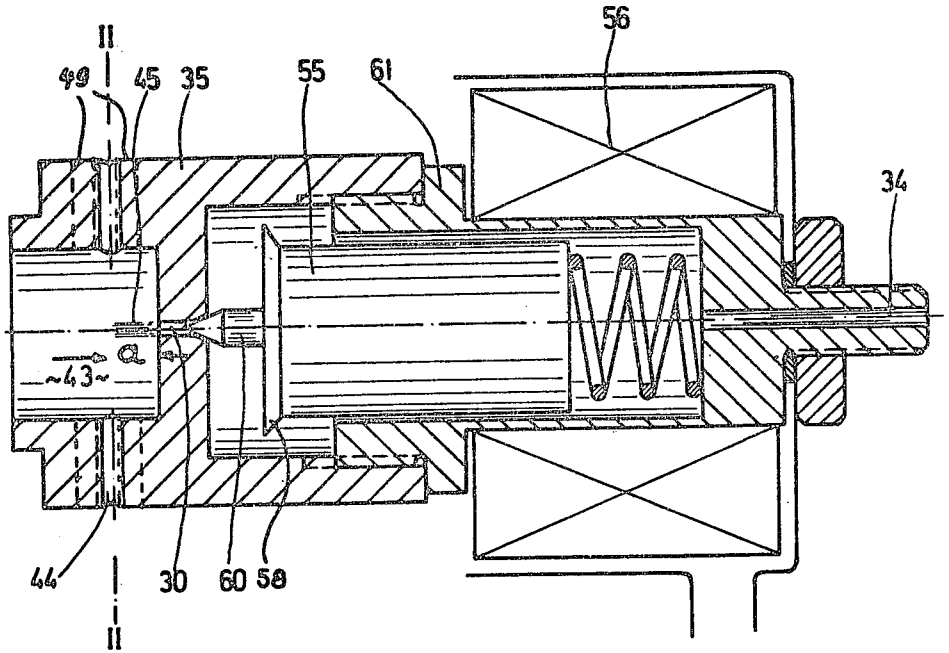
FIG. 3 shows on enlarged scale the mixing chamber proper including the closure thereof.

Further, it is possible to provide in the place of one nozzle belt, a plurality of nozzle belts in tandem in the axial direction (indicated in broken lines at 49; compare FIG. 3).

The front or end wall 51 forms the terminal end of a customary heating boiler being provided with the conventional heat exchanger pipes (not shown) and side walls 52. Owing to the favorable atomization, mixing and gasification with subsequent combustion with a short flame, it may be dispensed with providing a brickwork in the boiler; the boiler wall surfaces may be cooled. However, it is expedient to provide a cooling jacket wherein the boiler water to be heated is preheated. Preferably, there is further provided on the inner side of the end wall, a burner shell or jacket 63 having a substantially greater diameter than the diameter of the mixing and atomizing chamber, and which concentrically surrounds the opening of this chamber. The burner shell 63 may be formed, for instance, cylindrically or to open frusto-conically, or so as to taper. Other configurations are conceivable, too.

The intense swirling motion or vortex (cyclon) produced within the mixing chamber by blowing in the combustion and atomizing air, advances in the direction of the burner shell 63, thereby providing for the generation of a stable, concentrated flame.

The fuel jet 45 (compare FIG. 3) does not leave the outlet port 30 in a droplet form, i.e. in an atomized state; rather, it exists initially as a compact jet having a diameter of e.g. 1 mm. The oil consumption of this arrangement, when operated with 75% of full load, amounts from to about 3 to 4 kg of oil per hour. Due to turbulence and the centrifugal forces being effective within the cyclon, the jet is completely engaged or closed interiorly and exteriorly of the mixing chamber so as to be divided into fine droplets and burnt in the area of the burner shell. Hereby, it has to be noted that the droplet size is reduced to such extent that soot-free combustion with a blue flame takes place.

For starting the combustion, the first embodiment is provided with a conventional ignition device 47 producing a high-voltage spark between a pair of electrodes. The electrode necks are passed through a suitable bore in end wall 51. Further, a flame monitor 46 is provided for monitoring the flame and which is operative to stop operation when a flame fails to appear.

As the bore 30 through which the fuel oil is supplied, has a diameter of from 1 to 2 mm (or smaller or larger than this value depending on construction), minor quantities of contaminants which are normally present in the fuel, will not cause clogging of the inlet port such that the possibility for trouble in operation is minimized. Test runs have shown that with a diameter of bore 30 of between 1 and 2 mm and with a pressure of the atomizing air in the range of from 0.03 to 0.5 bar prior to entering the air channels, a negative pressure or vacuum may be produced within the mixing chamber 43 which is sufficient to suck in the fuel—i.e. fuel oil EL—without assistance by pumps in conduit 32, and to form a compact jet of adequate flow rate (i.e. 2 to 3 kg oil per hour).

Further control facilities for the burner assembly are provided by the adjustability of the float control 33 so as to allow to regulate the fuel supply.

It has been found that the diameters of the air channels 44 or 49 and the diameter of bore 30 have to be matched to each other. For example, it has been found that 12 air channels 44 of 3 mm diameter each and which are each fed with an air pressure of between 0.03 and 0.3 bar, are compatible with a diameter of the bore 30 of 1 mm with an inflow rate of from 2 to 3 kg oil per hour (depending on the vacuum) at medium load. Hereby, it is also of importance that the differential pressure caused by the level difference between the float control and the fuel inlet is equal to a fuel column of between 0 and 30 mm.

It has been noted that when oil inlet port 30 was reduced to 0.5 mm under the above-specified conditions, a stable flame could not be obtained anymore.

Since the conditions for any operational states which may be encountered, must be individually determined by experiments being the task of experts, the above brief notices may be sufficient here.

Control of the burner performance may be effected by adjustment of the air supply by the compressor 40, whereby the negative pressure within the mixing chamber is variably adjusted and, thus, the fuel supply through conduit 32 and bore 30 is controlled. Control can take place in a plurality of stages between the stages "full load" and "zero". Still further, the bores or apertures 44 and 49, respectively, may be opened and closed for control even by dampers, gates and the like.

Deactivation of the burner is effected simply by closing the bore 30 by means of valve needle 60. Accordingly, the present apparatus does not require any complicated extinction and shut-off controls which are necessary for atomizing nozzles.

Figure 2:
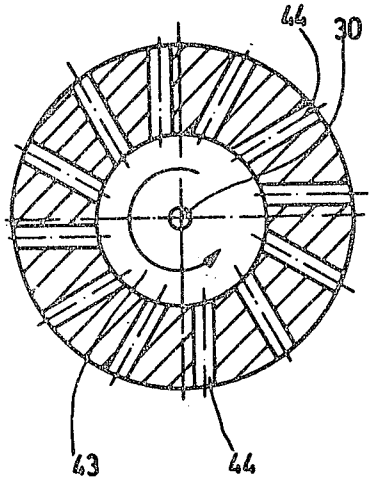
FIG. 2 is a sectional view along lines II—II in FIG. 1.

FIGS. 2 and 3 illustrate the details of the armature coil assembly on somewhat enlarged scale. For example, the following dimensions are used:

Diameter of chamber 43: 15 mm,
Diameter of supply channels 44: 3 mm,
Diameter of fuel inlet 30: 1 mm,
Length of chamber: 11 mm.

The length diameter ratio of chamber 43 should be in the range of from about 0.5:1 to 1:0.5. These exemplary dimensions are not intended to restrict the invention thereto. They are only specivied to verify the efficient mode of application of the invention.

Figure 4:
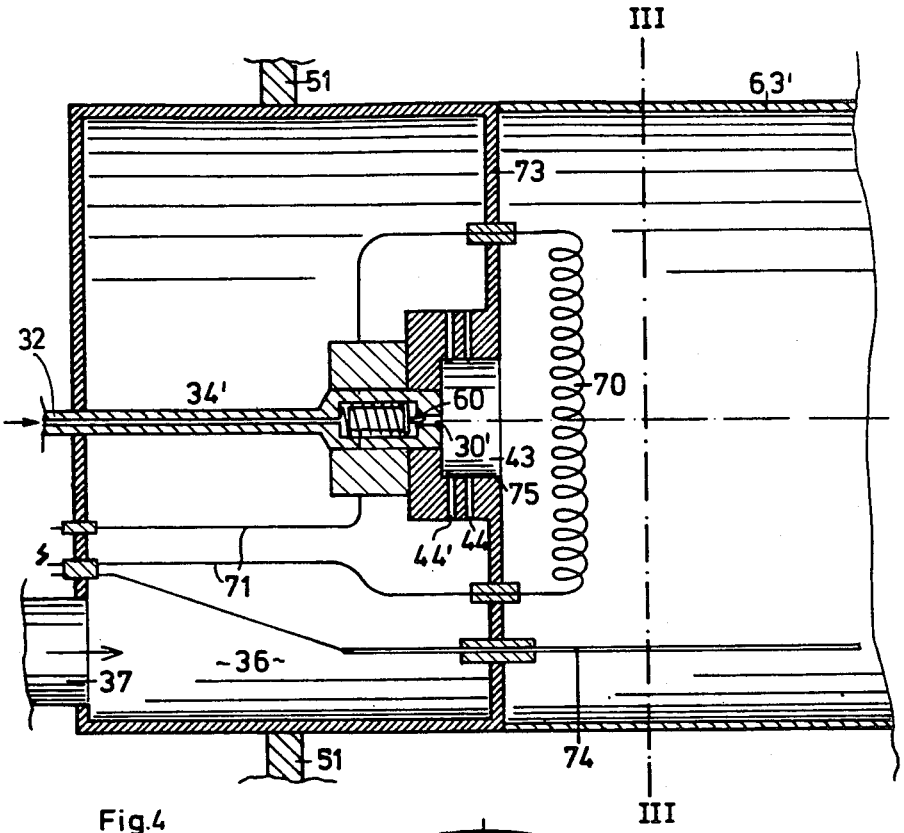
FIG. 4 shows a detail of the burner assembly, similar to FIG. 1, but in a modified embodiment, namely with a glow filament.
Figure 5:
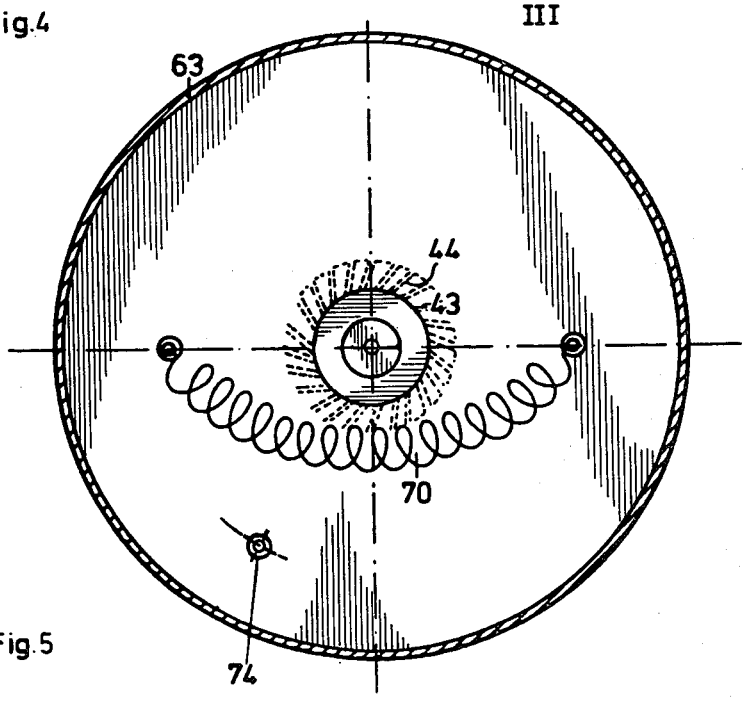
FIG. 5 is a sectional view along lines V—V in FIG. 4.

FIGS. 4 and 5 illustrate another embodiment of the burner. The fuel conduit 32 terminates in an inner line 34' communicating with another bore 30' adapted to be closed. The control or closure bore 30' is adapted to be opened and closed by means of the adjustable valve needle 60. The other details of the closure mechanism are similar to that of FIG. 1 and need not be explained in detail again.

The liquid fuel is supplied from the inlet bore or port 30 into the mixing and atomizing chamber 43 which is surrounded or enclosed by a cylindricyl shell which has opening thereinto a pair of belts (circular assemblies) of axially spaced air channels 44, 44'. These channels are spaced from the outlet opening of bore 30 in a distance of preferably 5 mm and 8 mm, as measured from a projection of the center of bores 44, 44' to the axis of chamber 43.

For ignition and initiation of the combustion in the burner according to FIGS. 4 and 5, an ignition filament or helix 70 is provided which comprises a wire, about 1 mm thick, of a heat resistant, low oxidizing chromium-nickel alloy. The low filament of the ignition helix is mounted in such position that the jet of the unburnt mixture emitting from chamber 43 passes through this helix to become ignited thereby at a temperature of from about 700° to 900° C. of this jet. The ignition helix 70 is supplied with the energy for glowing through electrical lines 71.

Preferably, the glow filament is wound in the configuration of a spiral or helix; however, other configurations are also conceivable, for example a filament in zig-zagged configuration or in the form of a flat glow strip. Surprisingly, it has been found, that the use of the glow filament makes it possible to operate from the outset with an extremely lean, substantially stoichiometric fuel-air mixture. Accordingly, it is not necessary first to reduce the air volume by means of a movable damper or the like, and thereafter to increase the air volume when ignition has taken place.

At the end of the the ignition process, the helix is deactivated again. The helix is mounted in a position to lie in the area between the plane of the opening 73 and the flame front, i.e. in a relatively cool area, whereby the useful life of the helix is increased essentially. The spacing from the edge of the mixing and atomizing chamber is between about 5 and 40 mm. The spacing from the opening plane 73 or from the end wall 51, respectively, is between abaut 5 and 30 mm.

For monitoring the ignition process, an ionization sensor 74 is provided which continuously determines whether or not combustion takes place within the burner shell od jacket.

FIG. 5 is a view into the interior of the burner shell 63 in cross-section. As shown, the ignition helix 70, with the axis of the mixing and atomizing chamber extending horizontally, is mounted to extend below the opeing (mouth) of chamber 43 in the form of a segment of an arc with a relatively close spacing from the opening to chamber 43. At this place, it should be noted that the ignition element or the ignition helix may assume a different position, too, because it is not necessary to dispose it below the mixing and atomizing chamber. The helix complies with the requirement that the vortices emanating from chamber 43 pass through a maximum space assumed by the helix 70, so as to securely and reliably initiate ignition.

The edge 75 of the mixing and atomizing chamber is rounded on its outer side in order that the path of the flow is partially diverted from the axial direction under the Coanda effect. In this way, a highly diverging flame cone may be produced the opening or diverging angle of which is between 90° and 180°. In this structure, the glow element, particularly an ignition helix, should closely contact the end wall 51 or be fitted into a groove.

Figure 6:
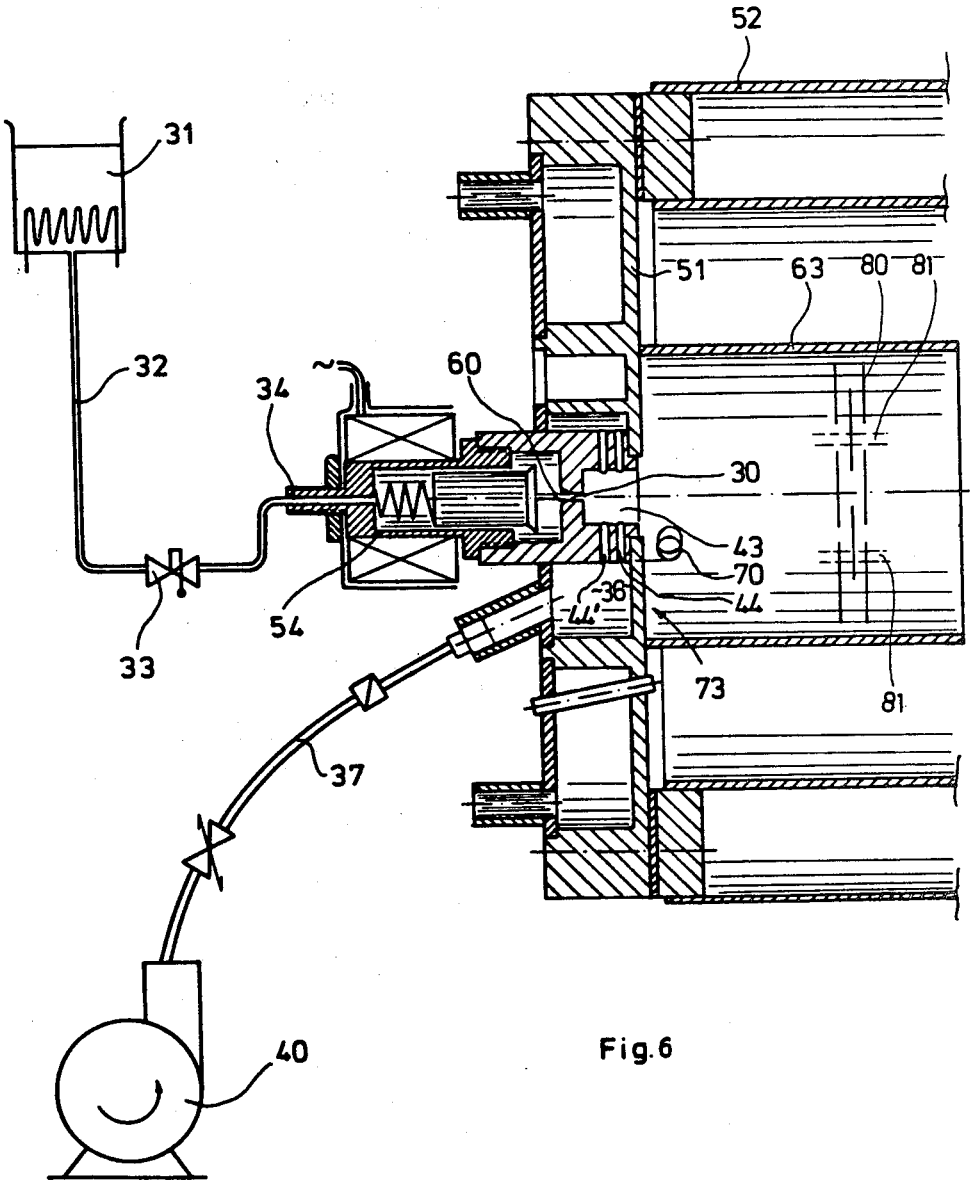
FIG. 6 is a general sectional view corresponding substantially to FIG. 1 but showing a different jacket tube.
Figure 7:
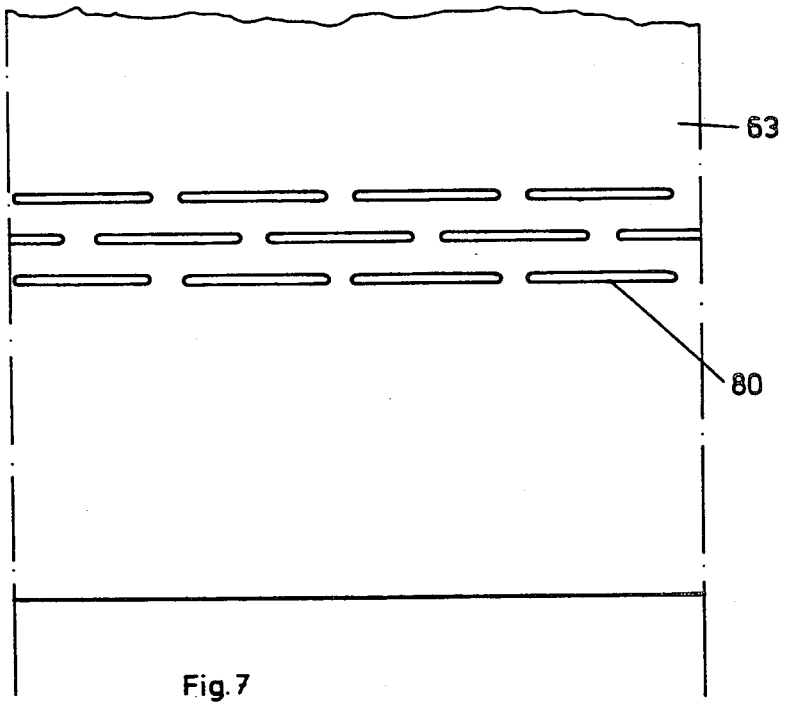
FIG. 7 is a development of the slotted jacket tube according to FIG. 6.

FIGS. 6 and 7 illustrate another exemplary embodiment of a burner assembly. The fuel, normally fuel oil EL having a viscosity of about 5 cst at 20° C., is supplied from the reservoir 31 through conduit 32 to the burner proper. The other details have already been described above.

In order to reduce the high heat flow from the edge of the shell tube 63 to the housing, according to FIGS. 6 and 7 the shell tube 63 includes in the last third of its length an array of threee by four slots 80 extending in circumferential direction and slightly overlapping each other. These slots have a width of about 1 mm and a length of slightly less than one-fourth of the peripheral length of shell tube 63 each. Adjacent the ends of these slots, beads 81 are pressed into the shell tube to increase its strength.

In addition to this configuration, of course other arrangements are possible, too, such as, for instance, longer slots each extending about one-half of the peripheral length of the shell tube 63 and overlapping each other in a similar fashion as a brick layer laid in interlocking mode; in this case, three or four slots extending in parallel with each other may be used, for example. It is important that the heat flow from the free end of the shell tube to the end wall 51 is interrupted. Under this aspect, it is also possible to form the shell tube of two components and to interpose between these two shell tube parts a ring of a material with low thermal conductivity, such as of ceramic fiber material.

Also, the slots may be displaced more towards the center of the shell tube, as seen in axial direction. The stream of the hot combustion gases and the flame front are preferably taken into account in such a way that the slots are located in front of the portion where the hot gases impinge, as seen from the mixing and atomizing chamber.

When a heat flow interruption of this kind is used, it shows that the area around the mixing and atomizing chamber and the end wall 51 are by far less heated, such that bore 30 is kept in a more uniformly heated condition so as to provide a uniform flow of fuel even after prolonged periods of operation.

For ignition and initiation of the combustion, an ignition spiral or helix is provided which is passed through by the jet of the unburnt mixture exiting from chamber 43, such that this mixture is ignited at a temperature of from 700° to 900° C. thereof It has been found that the use of a glow filament provides the possibility of operating the assembly from the outset with an extremely lean, substantially stoichiometric fuel-air mixture.

As another possibility, there may be noted the mounting of the shell tube to the end wall with the aid of fastening elements, e.g. annular elements of ceramic material having low thermal conductivity.

Figure 8:
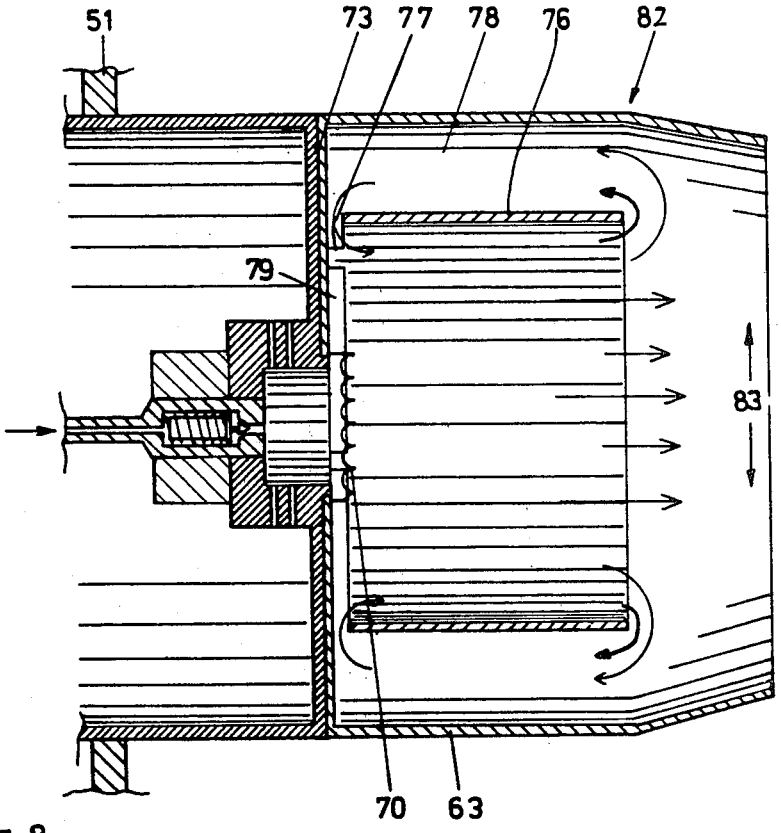
FIG. 8 shows a detail of another embodiment of a jacket tube with a directing or baffle sleeve.

FIG. 8 illustrates another embodiment, wherein a cylindricyl baffle sleeve 76 is provided within the burner shell 63 and in concentric relation thereto, said shell being mounted to the end wall 73 by means of supports 77. The fuel-air mixture flowing out with vortices is in part drawn at the rear of the baffle sleeve into the clearance between this sleeve and the burner shell 63 and thereafter again drawn, through peripherally spaced suction ports 79, into the flow of mixture adjacent the axis. The flow direction is indicated by arrows. The baffle sleeve is formed of a heat resistant material. In order to allow for adjustment of the sleeve in axial direction, the sleeve may be provided with slots or elongated bores, whereby the sleeve may be secured in various positions relative to the respective support to the thereby define varied free widths of the suction ports 79.

With the use of a directing or baffle sleeve 76 the diameter of which amounts to about 50 to 80% of the diameter of the burner shell, surprisingly the operating air pressure of the fan or blower 40 may be greatly reduced. Measurements have shown that the required air pressure, while maintaining the same quality of the flame, may be decreased to about 50% of the air pressure which can be selected without any flow-directing elements.

The material of the directing elements or of the baffle sleeve, respectively, is preferably a highly heat resistant, sintered or pressed ceramic fiber material of Si, Al or Zr carbides which are known e.g. under the tradenames Refrax (manufacturer: Carborundum) or Fiberfax.

Flame stabilization is enhanced by the fact that the burner shell or jacket projects beyond the baffle sleeve, and that this shell is provided with a constriction 81 in the projecting portion. This constriction, embodied as a truncated cone, may decrease the maximum diameter by, for example, from 5 to 20% such that there are left only from 95 to 80% of the original diameter or even less in certain cases.

What we claim is:

1. A method of operating a burner having igniting means for igniting atomized liquid fuel flowing from a fuel supply through a burning chamber in a burner shell and having a cylindrical wall having a fuel inlet port in an end wall attached to the cylinder and defining a vortex chamber, said cylindrical wall having a plurality of air channels each being inclined in the same direction and being disposed at angles between 10° to 60° to a radial direction through the cylindrical wall for receiving air under pressure from air supply means with the liquid fuel being supplied under no pressure to said port, said method comprising the steps of:

flowing fuel under positive pressure to an inlet side of a fuel valve means and providing liquid fuel at an outlet side of the valve means under negative pressure so that liquid fuel will not flow through the port except under a larger negative pressure created with the vortex chamber, flowing air under a predetermined pressure through said air channels and in the same direction to form a vortex in said vortex chamber at the longitudinal axis to produce a negative pressure therein to draw liquid fuel in a compact stream through the port and into the chamber, the liquid fuel stream traveling into a vortex of air streams issuing from said channels and being atomized thereby, traveling said atomized liquid fuel and substantially all of the air in said vortex longitudinally and outwardly from said vortex chamber and into the burning chamber in the burner shell without any additional pressurized air being added at the burner shell and past in igniting means for igniting the atomized liquid fuel to burn under stoichiometric conditions, said combusted fuel flowing through the burner shell, and varying the volume of air being supplied per unit of time to said vortex chamber to change the negative pressure therein and thereby varying the volume of fuel per unit of time being pulled through said port.

2. The method according to claim 1, characterized in that said flowing of the air step includes controlling of the burner efficiency by metering the air introduced into said mixing and atomizing chamber.

3. An apparatus for the combustion of liquid fuel, comprising:

a burner assembly having a cylindrical wall forming a cylindrical vortex chamber therein, said chamber having a longitudinally extending axis, an end wall closing one end of said cylindrical wall, a port in said end wall located on said longitudinal axis for discharging a compact stream of liquid fuel into said vortex chamber, a burner shell having a burning chamber of substantially greater diameter than said cylindrical wall of said vortex chamber and concentric therewith, and into which atomized fuel and air travel from said vortex chamber for ignition and for burning, liquid fuel means including a fuel reservoir holding a supply of liquid fuel and for supplying fuel at a positive pressure, a valve means having an inlet side receiving the liquid fuel at its inlet side, an outlet side of said valve means being connected to said port for supplying fuel at negative pressure, said valve means assuring that no liquid fuel flows through said port except under negative pressure created within the vortex chamber and applied to said port to draw liquid fuel through said port, a power driven air supply means for delivering air under predetermined pressure to said cylindrical wall, said burner shell being unconnected to said air supply means, means for igniting the atomized liquid fuel in said vortex chamber, a plurality of air channels in said cylindrical wall for conveying pressurized air from the exterior to the interior thereof, each of said air channels being inclined in the same direction and at an angle for 10° to 60° from a radial direction from the axis of said longitudinal axis to create a negative pressure and a vortex in said vortex chamber at the longitudinal axis to pull said liquid fuel from said liquid fuel means and through said port in a liquid stream and then for atomizing the liquid fuel for stoichiometric combustion while substantially all the air circulating in said vortex is flowing longitudinally outward of said cylindrical wall and into said burning chamber, said air supply means being variable to vary the volume of air being supplied per unit of time and for changing the negative pressure in said vortex chamber and thereby varying the volume of fuel per unit of time being pulled through said port.

4. An assembly in accordance with claim 3 wherein twelve air channels are spaced in a cylindrical pattern in said cylindrical wall forming said vortex chamber.

5. An assembly in accordance with claim 4 in which said means for igniting the atomized liquid includes a glow element which is elongated and extends circumferentially and is positioned in a relatively cool portion of said burmer assembly.

6. An assembly in accordance with claim 3 in which an armature-coil assembly having a needle valve is positioned to selectively open or close said port to fuel flow therethrough.

* * * * *